United States Patent [19]

Bailey et al.

[11] Patent Number: 4,533,003

[45] Date of Patent: Aug. 6, 1985

[54] DRILLING APPARATUS AND CUTTER THEREFOR

[75] Inventors: Thomas F. Bailey; John E. Campbell; Allen K. Rives; Nehal M. Shah, all of Houston, Tex.

[73] Assignee: A-Z International Company, Houston, Tex.

[21] Appl. No.: 587,490

[22] Filed: Mar. 8, 1984

[51] Int. Cl.[3] ..... E21B 10/32; E21B 10/22

[52] U.S. Cl. ..... 175/269; 175/371; 384/96

[58] Field of Search ..... 175/269, 367, 285, 370, 175/372, 371, 359, 337; 384/96, 92

[56] References Cited

U.S. PATENT DOCUMENTS

| | | | |
|---|---|---|---|
| 2,061,141 | 11/1936 | Crum | 384/96 |
| 2,210,077 | 8/1940 | Hanly | 384/92 |
| 2,787,502 | 4/1957 | Huckshold | 384/96 |
| 3,171,503 | 3/1965 | Shirley | 175/269 |
| 4,156,470 | 5/1979 | Bodine et al. | 175/337 X |

FOREIGN PATENT DOCUMENTS

| | | | |
|---|---|---|---|
| 1053319 | 2/1954 | France | 384/96 |

*Primary Examiner*—Stephen J. Novosad
*Assistant Examiner*—Thuy M. Bui
*Attorney, Agent, or Firm*—Vinson & Elkins

[57] ABSTRACT

An underreamer, hole opener, or expansible rotary drill bit including a body having a bore therethrough, an arm mounted at its upper end to the body, a conical cutter mounted for rotation on the lower end of each arm, a cup-shape thrust bearing between the cutter and the arm, a bolt through the arm to secure the cutter on the arm and means including a ball and groove between the bolt and the cutter to lock the bolt to the cutter. In the underreamer form of the present invention, the arms are pivotally mounted in slots in the body and means is provided for moving their arms to their cutting position with their lower ends positioned radially outward from the body.

10 Claims, 3 Drawing Figures

DRILLING APPARATUS AND CUTTER THEREFOR

BACKGROUND

Underreamers, expansible cutters and hole openers have been used for enlarging well bores either connected to a drill string above the drill bit or in the string without any drill bit on the lower end of the string. U.S. Pat. No. 3,386,521 is an example of the combined drill bit and underreamer and U.S. Pat. No. 3,171,503 is an example of an underreamer on the lower end of the drill string.

Conical cutters have been used in drill bits and underreamers. Such conical cutters have been installed on a pin which extends downwardly and inwardly from the lower end of the underreamer arms. Roller bearings and balls have been used in mounting the conical cutters on the arms as shown in U.S. Pat. No. 2,641,447. Pins or balls locked in a groove between the arm and the interior of the conical cutter have been used to secure the cutters on their pins as shown in U.S. Pat. Nos. 2,641,447; 3,998,500; and 2,519,716. U.S. Pat. No. 4,161,343 discloses the use of a friction bearing and a thrust button between the pins and the cutters. U.S. Pat. No. 3,998,500 suggests the use of a bolt to secure a bearing sleeve on the pin.

The amount of cutting that can be obtained from a conical cutter on an underreamer has been limited by the time in cutting service during which the cutter rotates relatively freely and this is a function of the efficiency of its mounting.

SUMMARY

The present invention relates to an improved underreamer, hole opener, or expansible rotary drill bit with a conical cutter having an improved cutter mounting. The underreamer includes a body with a bore therethrough, an arm pivotally mounted to said body at its upper end with a pin on its lower end, a conical cutter having a central bore and a counterbore, means for securing said pin in said central bore of the cutter and an annular cup-shaped thrust bearing positioned between the exterior and end of said pin and the wall of said counterbore and the shoulder between the counterbore and the central bore.

An object of the present invention is to provide an improved underreamer with a conical cutter which has an extended service life.

Another object is to provide an improved underreamer with a simple and durable mounting of its conical cutter to the pivotal underreamer arm.

A further object is to eliminate welding in the assembly of cutters on their arms which might weaken or destroy the effectiveness of portions thereof, such as carburized bearing surfaces.

BRIEF DESCRIPTION OF THE DRAWINGS

These and other objects and advantages are hereinafter set forth and explained with reference to the drawings wherein.

DESCRIPTION OF THE PREFERRED EMBODIMENT

Figure 1:
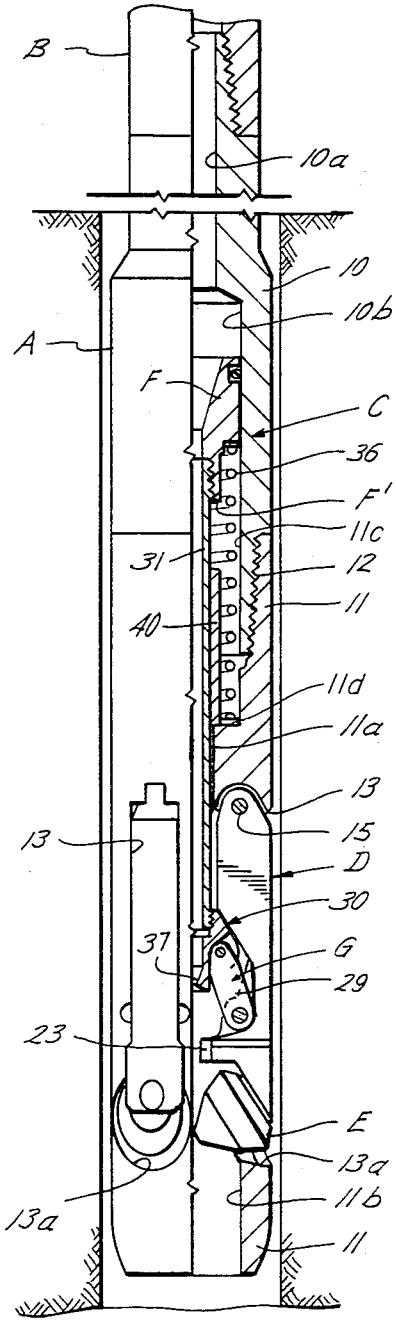
FIG. 1 is a view partly in section and partly in elevation showing the improved underreamer of the present invention in retracted or running position.
Figure 2:
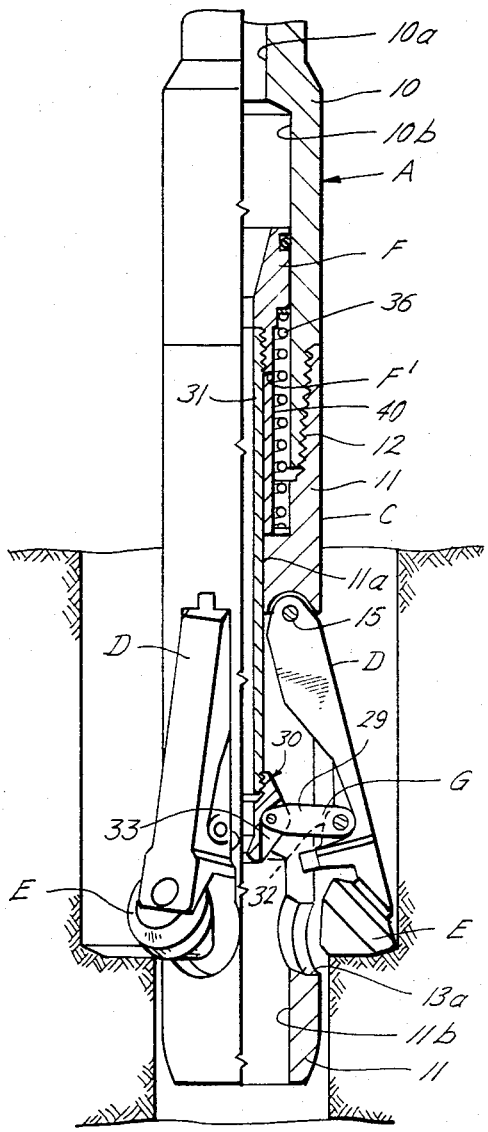
FIG. 2 is a similar view showing the underreamer in extended or cutting position.

In the drawings, the letter A designates the expansible rotary drill but or underreamer tool comprising the present invention and the upper end of said tool is adapted to be secured to the lower end of a string of drill pipe B extending to the top of a well bore, by means of which said tool is ordinarily lowered through a string of well casing (not shown) to an area below said casing where the hole enlarging operation is to be carried out. In general, the tool comprises main body portion C within which are provided cutter carrying elements or connecting arms D having cutter assemblies E at their lower ends. Actuating piston F is movable within the bore of main body portion C and has connection with links G which connect said piston to cutter carrying elements or arms D. When piston F is moved downwardly, the lower ends of links G are swung outwardly and being connected to the lower portions of cutter carrying arms D, said arms are swung outwardly to move cutter assemblies E outwardly into their expanded cutting position as shown in FIG. 2. In such position, a rotation of the drill string rotates main body portion C and the cutter carrying elements, whereby cutter assemblies E will enlarge or drill out the well bore. When the piston returns to its upper position as shown in FIG. 1, links G connected therewith function to retract the cutters.

Body portion C comprises upper tubular section 10 having its upper end connected to drill pipe B and lower housing 11 which is connected to the upper section by threads 12. Upper section 10 has bore 10*a* which communicates with the bore the drill pipe and counterbore 10*b* within which piston F is slideable. Housing 11 has axial bore 11*a* extending entirely therethrough and lower end 11*b* of said bore is enlarged as clearly illustrated in FIGS. 1 and 2.

A plurality of vertically extending slots 13 are formed within the body for the reception of the cutter carrying elements or arms D and as shown, three such slots are provided, although the number may vary. Each slot 13 extends longitudinally of housing 11, and openings for the reception of the ends of pivot pin 15, which pivots a cutter carrying element within a slot, are drilled in the side walls of each slot. The lower end of each slot terminates in circular opening 13*a* through which cutter assembly E, mounted on the lower end of each cutter carrying arm D, may move.

The construction of each cutter carrying element or arm D is substantially rectangular in cross-section, being provided with an ear at its upper end having a transverse opening therein. The width of each arm is substantially the same as the width of slot 13 and when arm D is in position within the slot, pivot pin 15 extends through the opening with its ends engaged in openings in housing 11, whereby each arm is pivotally mounted within each slot.

By reason of pivot pin 15 at the upper end of each arm, the arms may be swung outwardly beyond the confines of the outer surface of housing 11 so that cutter assemblies E will be expanded as shown in FIG. 2.

For effecting a simultaneous expansion of cutter arms D, each cutter arm has connection through a pair of links 29 with connecting element 30, which element is directly connected through tubular sleeve 31 with the lower end of annular piston F. Connecting element 30 has a plurality of outwardly projecting lugs 33, each having an opening or recess therein. The upper ends of links 29 are disposed one on each side of each of the lugs 33 and each has a inwardly projecting pin which engages within the opening or recesses of the lug on element 30 to pivotally connect the upper ends of said links to said lug. Links 29 are disposed one on each side of the boss 32 which is formed in the inner face of each arm D and openings in the lower ends of links align with the opening in the boss to receive a pivot pin.

When the annular piston F is in its raised position to which it is urged by a coil spring 36, the connecting element 30 is also raised to be in close proximity to the inclined surface on the interior of each cutter arm D. By reason of the connection with the links 20, the links are swung to the position shown in FIG. 1 which causes their lower ends to move inwardly and maintain each arm retracted within the housing. An orifice ring 37 is mounted within the lower portion of the bore of the connecting element 30 (FIG. 1) and when pressure fluid is pumped downwardly through the drill stem and through the annular piston F as well as the connecting sleeve 31, the orifice ring creates a restriction which will cause a pressure buildup above piston F. When this increased pressure overcomes the force of the coil spring 36, the piston F, sleeve 31 and connecting element 30 move downwardly with respect to the housing and to the cutter arms. This moves the upper pivot point between the connecting links 29 and element 30 downwardly which results in an outward swinging movement of the lower ends of the links 29, such outward swinging movement causes the cutter arms D to pivot about the upper pin 15 whereby the lower ends of the arms are swung outwardly to move the cutters E to an expanded position. In order to control the radial expansion of the cutter arms, the downward movement of the annular piston F is limited by a stop sleeve 40 which surrounds the connecting sleeve 31 and rests upon an annular shoulder **11*d* formed between the bore 11*a* and the counterbore 11*c* of the housing 11. When the lower end of the piston engages the upper end of the stop sleeve 40, further downward movement of the piston is prevented to thereby limit the extent to which the lower end of links 29** are swung.

After the cutter arms have expanded to locate the cutter assemblies E radially outwardly of the housing 11, a rotation is imparted to the drill string B and is transmitted to the housing. By reason of the contact between the side wall of each slot 13 with the side surface of each cutter arm D and the outer surface of each inwardly extending driving lug 23, this rotation is imparted to the arms D to perform a drilling or underreaming operation. By providing the inwardly extending drive lugs 23 on arms D, the effective side of each cutter arm which is contacted by the side wall of its respective slot is extended so that the range to which the cutter arm may be swung without losing the driving connection between housing 11 and cutter arms D is greatly increased. The driving lugs 23 are positioned at one side of the inner surface of each cutter arm so that they will not interfere with full retraction of the cutter arms, the interfitting position of the lugs in fully retracted position being shown in FIG. 1.

Figure 3:
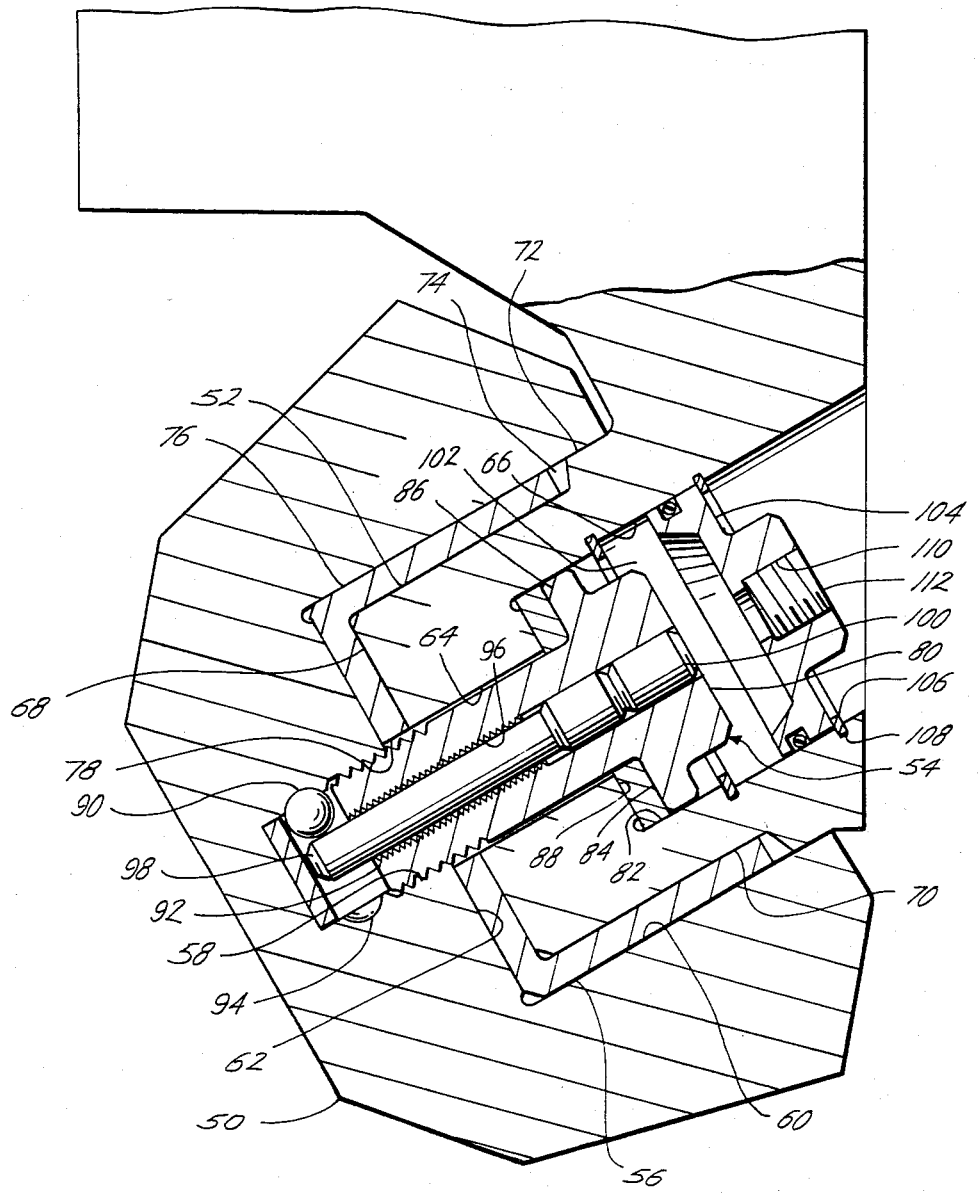
FIG. 3 is a detailed sectional view of the pin on the lower end of the underreamer arm and the mounting of the conical cutter thereon.

As shown in FIG. 3, cutter assembly E includes conical cutter 50 having suitable formation engaging elements (not shown), such as teeth or inserts, means 54 to secure cutter 50 rotationally on pin 52 of arm D and thrust bearing means generally indicated 56 interposed between the interior of cutter 50 and the exterior of pin 52 to ensure freedom of rotation of cutter 50 on pin 52 during cutting.

Cutter 50 is suitably shaped on its exterior as is well known in the art of conical cutters and has an internal threaded central bore 58 and counterbore 60 with annular shoulder 62 therebetween. Pin 52 extends downwardly and inwardly from the lower end of arm D and defines a central bore 64, a counter bore 66, a lower end surface 68 which surrounds bore 64 and is normal thereto, a lower outer peripheral surface 70, an upper outer peripheral surface 72 of an increased diameter and inwardly facing shoulder 74 between surfaces 70 and 72.

Thrust bearing means 56 comprises a thrust bearing 76, of suitable material as is well known, having an annular cup shape with central opening 78 which when thrust bearing 76 is positioned in cutter 50 surrounds central bore 58 so that bolt 80 extends through bore 64 and opening 78 and threads into central bore 58. Thrust washer or bearing 82 is positioned between surface 84 on the underside of bolt head 86 and annular surface 88 between central bore 64 and counterbore 66 in pin 52. Bolt 80 is retained by its threads in position in cutter 50 and prevented from unthreading by ball 90 which is positioned in port 92 in the lower end of bolt 80 and in groove 94 around the lower end of central bore 58. Ball 90 is inserted through bore 96 in bolt 80 and is forced outward in port 92 extending through bolt 80 into internally threaded groove 94 by pin 98. Set screw 100 is threaded onto bore 96 to urge ball 90 outwardly into groove 94 thereby to retain pin 98 in position.

Lubrication is provided to thrust bearings 76 and 82 and other parts of cutter assembly E from chamber 102 in pin 52 with piston 104 closing the outer portion of chamber 102 and assuring that any pressure from outside cutter assembly E is exerted on the lubrication system to prevent the entry of trash and cutting into the bearing areas. Snap ring 106 is positioned in groove 108 in counterbore 66 to retain piston 104 in from moving outward of its maximum desired outer position. Preferably piston 104 has central bore 110 for supplying lubricant to chamber 102 and plug 112 closes and seals bore 110 when chamber 102 has been filled with lubricant.

The improved mounting of conical cutter 50 on pin 52 of arm D allows free rotation of the cutter during underreaming operations, provides rugged and long lasting bearing surfaces faces which are supplied with lubricant through a pressure balanced lubrication system and provides a novel securing means which ensures that the conical cutter is retained on the pin. Since the improved cutter mounting does not involve welding, the possible damage or destruction of portions thereof is avoided.

It should be understood that with the above description, a link-type of arm actuation is disclosed but other types of structure such as a ramp-type of arm actuation may be used. Also, the present invention has application to hole openers having fixed arms such as is shown on Page 188, of the A-Z International Tool Company General Catalog for 1984–1985.

What is claimed is:

1. A drilling apparatus comprising a body having a bore therethrough and a longitudinal slot in its wall, an arm mounted at its upper end to said body and having a pin extending from its lower end with a central bore therethrough, a conical cutter having formation cutting means around its outer periphery, a small diameter threaded bore, and an enlarged diameter counterbore defining a shoulder between said threaded bore and said counterbore, means extending through the pin bore of said arm and into said cutter bore to secure said cutter rotationally on said pin, and thrust bearing means including a cup-shaped bearing surrounding said pin and engaging said counterbore and the shoulder between said counterbore and said cutter bore.

2. An apparatus according to claim 1 wherein said means to secure said cutter includes a bolt having a head and a threaded shank and extending through the pin bore in said arm and engaging in said central internally threaded bore of said cutter.

3. An apparatus according to claim 2 including bearing means between the head of said bolt and said pin.

4. An apparatus according to claim 2 including means for locking said bolt in engagement within said threaded bore.

5. An apparatus according to claim 4 wherein said locking means includes an internal annular groove within said threaded bore, a bore extending transversely through the end of said shank, a ball in said transverse shank bore, and means for forcing said ball into said groove.

6. An apparatus according to claim 5 wherein said ball forcing means includes an axial bore through said bolt, a pin in said axial bore, and means retaining said pin in engagement with said ball.

7. A drilling apparatus comprising a body having a bore therethrough, an arm mounted at its upper end to said body and having a pin extending from its lower end with a central bore therethrough, a conical cutter having formation cutting means around its outer periphery, a small diameter central threaded bore, and an enlarged counterbore defining a shoulder between said threaded bore and said counter, means extending through the pin bore in said arm and into said cutter bore to secure said cutter rotationally on said pin, thrust bearing means surrounding said pin and fitting within said counterbore in a seated position on the shoulder between said counterbore and said cutter bore.

8. An apparatus according to claim 7 wherein said conical cutter includes an internal recess to receive the lower end of said arm, a cup shaped thrust bearing in said recess between said cutter and the lower end of said arm, and means for retaining said cutter rotatively on the lower end of said arm.

9. An apparatus according to claim 7 including a plurality of arms with cutters mounted thereon.

10. An underreamer comprising a body having a bore therethrough and a plurality of slots in its wall, an arm pivotally mounted at its upper end to the body within each of said slots, means for moving the arms to their cutting position with their lower ends positioned radially outward from the body, a conical cutter mounted for rotation on the lower end of each arm, a cup-shape thrust bearing between the cutter and the arm, a bolt through the arm to secure the cutter on the arm and means including a ball and groove between the bolt and the cutter to lock the bolt to the cutter.

* * * * *